US005229708A

United States Patent [19]

Donig et al.

[11] Patent Number: 5,229,708

[45] Date of Patent: Jul. 20, 1993

[54] INTEGRABLE SHUNT REGULATOR

[75] Inventors: Günter Donig, Ottobrunn; Bruno Scheckel, Ebersberg; Karl-Reinhard Schön, Munich, all of Fed. Rep. of Germany

[73] Assignee: Siemens Aktiengesellschaft, Munich, Fed. Rep. of Germany

[21] Appl. No.: 837,278

[22] Filed: Feb. 18, 1992

[30] Foreign Application Priority Data

Feb. 18, 1991 [EP] European Pat. Off. ..... 91102283.8

[51] Int. Cl.[5] ..... G05F 1/613

[52] U.S. Cl. ..... 323/223; 323/313; 323/316

[58] Field of Search ..... 323/223, 220, 224, 226, 323/314, 313, 316; 307/296.1, 296.7, 296.6

[56] References Cited

U.S. PATENT DOCUMENTS

| | | | |
|---|---|---|---|
| 3,617,859 | 11/1971 | Dobkin et al. | 323/4 |
| 3,882,372 | 5/1975 | Martynow et al. | 323/8 |
| 4,088,941 | 5/1978 | Wheatley, Jr. | 323/8 |
| 4,160,201 | 7/1979 | Ahmed | 323/8 |
| 4,743,833 | 5/1988 | Johnson | 323/224 |
| 5,045,770 | 9/1991 | Brooks | 323/223 |
| 5,103,160 | 4/1992 | Bohac, Jr. | 323/351 |

FOREIGN PATENT DOCUMENTS 2226664 7/1990 United Kingdom .

OTHER PUBLICATIONS

IBM Technical Disclosure Bulletin, vol. 20, No. 3, Aug. 1977, (AZZIS) 1043-1044.

Tietze-Schenk (1986) Halbleiter-Schaltungstechnik pp. 534-537.

Linear Circuits Data Book, (1984) Texas Instruments pp. 6-98 to 6-107.

*Primary Examiner*—Steven L. Stephan
*Assistant Examiner*—Adolf Berhane
*Attorney, Agent, or Firm*—Herbert L. Lerner; Laurence A. Greenberg

[57] ABSTRACT

An integrable shunt regulator includes two connection terminals to be connected between poles of a supply voltage source. A controllable semiconductor component has a control input and a load path connected to the two connection terminals. A differential amplifier has first and second inputs and an output connected to the control input of the controllable semiconductor component. First and second transistors have emitter terminals and interconnected base and collector terminals connected to one of the connection terminals. A first resistor is provided. The emitter terminal of the first transistor is connected to the first input of the differential amplifier and is connected through the first resistor to the other of the connection terminals. A series circuit of second and third resistors has a connection node connected to the second input of the differential amplifier. The emitter terminal of the second transistor is connected through the series circuit of the second and third resistors to the other of the connection terminals.

6 Claims, 1 Drawing Sheet

INTEGRABLE SHUNT REGULATOR

Figure 1:
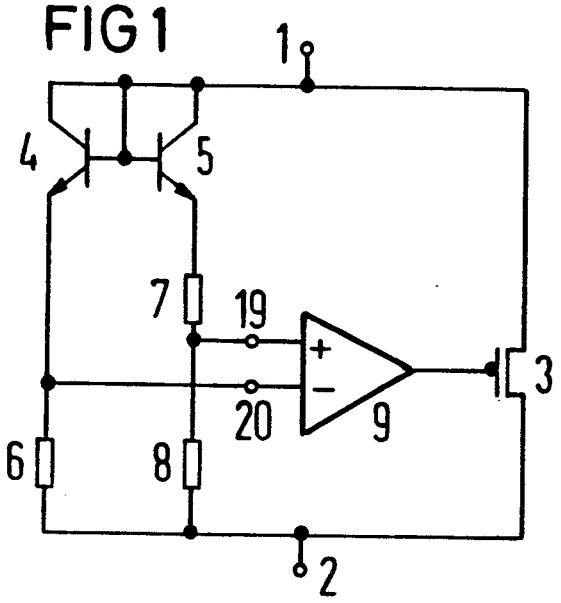

The invention relates to an integrable shunt regulator with a controllable semiconductor component having a load path which is connected between poles of a supply voltage source and a control input which is connected to an output of a differential amplifier.

Such a shunt regulator is used as a voltage regulator and is also known as a so-called parallel regulator. The load path of a semiconductor component, such as a power transistor, is located between the poles of the supply voltage to be regulated. The power transistor is controlled by an operational amplifier, which in turn is supplied by a reference voltage source. A so-called band gap reference is typically used as the reference voltage. This is known, for instance, from the publication Halbleiter-Schaltungstechnik [Semiconductor Circuitry], by Tietze and Schenk, 8th Edition, 1986, page 534 ff.

A shunt regulator that has both a band gap reference circuit and a parallel regulator is known from the Texas Instruments Linear Circuits Data Book, 1984, page 6–99 ff. That adjustable shunt regulator has three terminals. An anode and a cathode of the shunt regulator should be connected to the poles of a supply voltage, and a reference voltage must be delivered to the reference input, for instance through a voltage divider. The shunt regulator shown in the circuit on page 6–99 is relatively complicated in structure and has a regulated band gap reference circuit, with an externally adjustable voltage value, and an operational amplifier coupled thereto. Such a structure has the disadvantage of an increased tendency to oscillation because of the two coupled operational amplifiers.

High accuracy of the output voltage is not as necessary as the most space-saving possible construction of the shunt regulator, especially when such a shunt regulator is used in chip cards or chip keys. In such systems, a serial regulator is usually connected to the output side of the shunt regulator for accurate stabilization of the operating voltage. Thus, such a shunt regulator is used only for prestabilization.

It is accordingly an object of the invention to provide an integrable shunt regulator, which overcomes the hereinaforementioned disadvantages of the heretofore-known devices of this general type and which keeps the output voltage within a defined range, with as little effort and expense as possible.

With the foregoing and other objects in view there is provided, in accordance with the invention, an integrable shunt regulator, comprising two connection terminals to be connected between poles of a supply voltage source; a controllable semiconductor component having a control input and having a load path connected to the two connection terminals; a differential amplifier having first and second inputs and having an output connected to the control input of the controllable semiconductor component; first and second transistors having emitter terminals and having interconnected base and collector terminals connected to one of the connection terminals; a first resistor; the emitter terminal of the first transistor being connected to the first input of the differential amplifier and being connected through the first resistor to the other of the connection terminals; a series circuit of second and third resistors having a connection node connected to the second input of the differential amplifier; and the emitter terminal of the second transistor being connected through the series circuit of the second and third resistors to the other of the connection terminals.

In accordance with another feature of the invention, there are provided n additional transistors connected between the base and collector terminals of the first and second transistors, the n additional transistors including a first, an $n^{th}$, at least one $n+1^{th}$ and a last additional transistor, and the n additional transistors having base, emitter and collector terminals; the emitter terminal of the first additional transistor being connected to the base terminals of the first and second transistors; at least one additional resistor; the emitter terminals of each of the at least one $n+1^{th}$ additional transistor being connected to the base terminal of the $n^{th}$ additional transistor and being connected through a respective one of the at least one additional transistor to the base terminals of the first and second transistors; the base and collector terminals of the last additional transistor being interconnected; the collector terminals of the n additional transistors being connected to the collector terminals of the first and second transistors; and a further resistor connected between the base terminals of the first and second transistors and the other of the connection terminals.

In accordance with a further feature of the invention, the shunt regulator is constructed in CMOS technology, and the transistors are bipolar transistors formed by parasitic structures.

In accordance with a concomitant feature of the invention, there is provided a chip card or chip key in which the shunt regulator is provided.

The advantage of the shunt regulator according to the invention is that it has only two supply voltage terminals, with no control or reference input. The reference voltage is produced by means of a band gap reference circuit, so that the output variable of the regulating amplifier is itself the voltage to be regulated.

Other features which are considered as characteristic for the invention are set forth in the appended claims.

Although the invention is illustrated and described herein as embodied in an integrable shunt regulator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
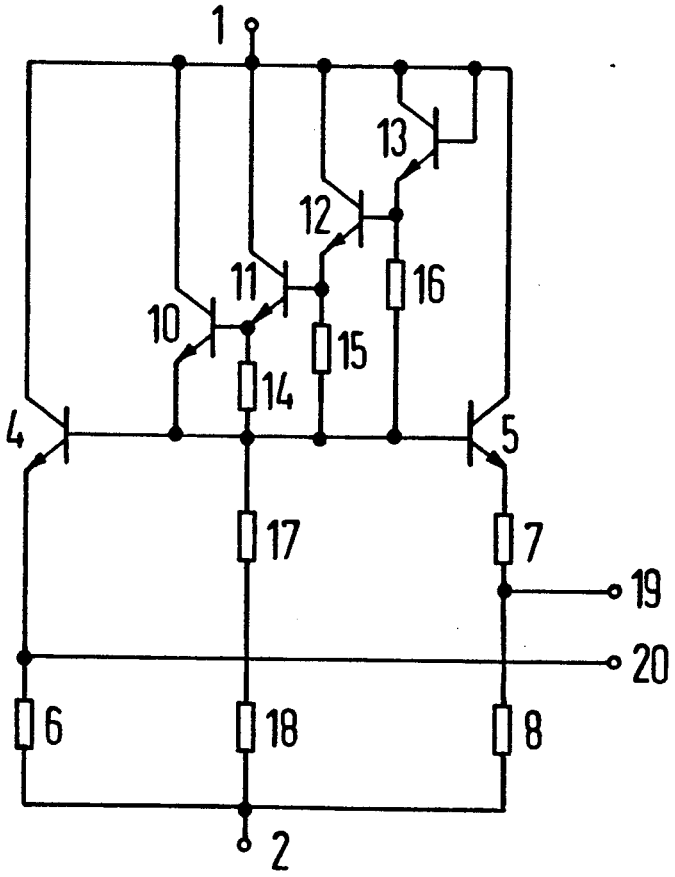

FIG. 1 is a schematic circuit diagram of a first exemplary embodiment of a shunt regulator according to the invention; and FIG. 2 is a schematic circuit diagram of an embodiment of a band gap reference circuit.

Referring now to the figures of the drawing in detail and first, particularly, to FIG. 1 thereof, there is seen a shunt regulator having first and second connection terminals 1, 2, to which the supply voltage source can be connected. In the example shown, the positive pole of the supply voltage source is applied to the terminal 1, and the negative pole of the supply voltage source is applied to the terminal 2. A semiconductor component such as a MOSFET 3, which is provided as a parallel regulator, has a load path which is connected between the connection terminals 1 and 2. Triggering of the MOSFET 3 is performed by an operational amplifier 9 having an output which is connected to a gate of the MOSFET 3. The operational amplifier has one first negative input 20 and one second positive input 19. First and second npn transistors 4, 5 are also provided. Base terminals and collector terminals of the two transistors 4, 5 are connected to one another and are connected to the input terminal 1. An emitter terminal of the first transistor 4 is connected to the second terminal 2 through a first resistor 6. The emitter terminal of the first transistor 4 is also connected to the negative input 20 of the operational amplifier 9. Furthermore, an emitter terminal of the second transistor 5 is connected to the terminal 2 through a series circuit of second and third resistor 7, 8. The series circuit of the two resistors 7, 8 has a connection node that is connected to the positive input 19 of the operational amplifier 9.

A band gap reference circuit is formed by the transistors 4, 5 and by the resistors 6, 7, 8. The output voltage of this band gap reference circuit is delivered to the operational amplifier 9, which in turn controls the MOSFET 3. Accordingly, regulation of the differential output voltage of the band gap reference circuit is combined with the regulation of the supply voltage. The value of the output voltage can be selected by selecting the resistances of the resistors 6 and 8. If the output voltage at the terminals 1 and 2 corresponds to the value defined by the resistors 6 and 8, then the input reference voltage of the operational amplifier becomes 0.

A disadvantage of the band gap reference circuit shown in FIG. 1 is that the temperature drift of the output voltage at the terminals 1 and 2 worsens to the same extent as the output voltage deviates from the band gap reference voltage. Moreover, setting the operating point of the operational amplifier 9 is difficult, because of the low threshold voltage of the bipolar transistors.

FIG. 2 shows an improvement to the band gap reference circuit of FIG. 1.

In addition to the circuit shown in FIG. 1, the band gap reference circuit shown in FIG. 2 furthermore has first, second, third and fourth additional transistors 10, 11, 12, 13. An emitter terminal of the first additional transistor 10 is connected to two base terminals of the first and second transistors 4, 5. An emitter terminal of the second additional transistor 11 is connected to a base terminal of the first additional transistor 10. An emitter terminal of the third additional transistor 12 is connected to a base terminal of the second additional transistor 11. An emitter terminal of the fourth additional transistor 13 is connected to a base terminal of the third additional transistor 12. Collectors of all four additional transistors 10, 11, 12, 13 are connected to collector terminals of the first and second transistors 4, 5. A base terminal of the fourth additional transistor is also connected with its collector terminal.

It is therefore seen that n additional transistors 10, 11, 12, 13 are provided, including a first (10), an $n^{th}$ (10, 11, 12), at least one $n+1^{th}$ (11, 12, 13) and a last (13) additional transistor.

Fourth, fifth and sixth additional resistors 14, 15, 16 are also provided. The fourth resistor 14 is connected between the emitter terminal of the second additional transistor 11 and the emitter terminal of the first additional transistor 10. The fifth resistor 15 is connected between the emitter terminal of the third additional transistor 12 and the emitter terminal of the first additional transistor 10. The sixth resistor 16 is connected between the emitter terminal of the fourth additional transistor 13 and the emitter terminal of the first additional transistor 10. Finally, a series circuit of seventh and eighth further resistors 17 and 18 is connected between the interconnected base terminals of the first and second transistors 4, 5 and the terminal 2. The other components shown in FIG. 2 correspond to those shown in FIG. 1 and have the same reference numerals. Once again, reference numerals 19 and 20 designate inputs or terminals that lead to the two inputs of the operational amplifier 9 of FIG. 1.

On one hand, adding the four base-to-emitter voltages of the additional transistors 10, 11, 12, 13, which are connected in series with the original band gap reference circuit, favorably shifts the differential input voltage of the following operational amplifier 9 from the potential located at the terminal 1, and on the other hand, it shifts the point of complete temperature compensation in this case by a factor of approximately 5. As compared with the circuit shown in FIG. 1, in which the value of the band gap reference voltage is approximately 1.2 V, the band gap reference voltage in this case is approximately 6 V. Accordingly, deviations from this voltage have less impact.

An expansion as shown in FIG. 2 is not limited to four transistors but can instead be arbitrarily increased or decreased within a reasonable limit. An essential feature of the invention is the raising of the band gap reference voltage by n series-connected transistors having collector terminals which are connected to the positive supply potential. In that case, the output voltage is temperature-compensated at $n+1$ times the value of the band gap reference voltage.

For the sake of easier adjustability of resistances, two resistances 17 and 18 were selected in FIG. 2. They can be arbitrarily replaced by one or optionally more resistors.

The circuit including the bipolar npn transistors can in particular be constructed in CMOS technology with an n substrate. The collector terminals of the bipolar npn transistors are formed by a common substrate. This is possible because only bipolar transistors that are connected as emitter followers are used. Such transistors are also known as parasitic "substrate npn transistors".

The circuit shown is particularly well suited to portable data carriers, such as so-called chip cards and chip keys, which have no power supply of their own and to which energy is supplied by means of two coils.

We claim:

1. An integrable shunt regulator, comprising:

two connection terminals to be connected between poles of a supply voltage source;

a controllable semiconductor component having a control input and having a load path connected to said two connection terminals;

a differential amplifier having first and second inputs and having an output connected to the control input of said controllable semiconductor component;

first and second transistors having collector terminals connected to one of said connection terminals;

a first resistor;

the emitter terminal of said first transistor being connected to said first input of said differential amplifier and being connected through said first resistor to the other of said connection terminals;

a series circuit of second and third resistors having a connection node connected to said second input of said differential amplifier;

the emitter terminal of said second transistor being connected through said series circuit of said second and third resistors to the other of said connection terminals; and n sequentially numbered additional transistors series connected between the base and collector terminals of said first and second transistors, said n additional transistors including at least a first, and a second additional transistor, said n additional transistors each having a base, an emitter and a collector terminal, forming a band gap voltage reference;

the emitter terminal of each of said additional transistors numbered greater than one being connected to the base terminal of a preceding next lower numbered transistor, and the highest numbered transistor having its collector and base connected to each other and the collector terminal of each of said additional transistors being connected to said one connection terminal.

2. An integrable shunt regulator according to claim 1, wherein said first and second transistors have respective bases, and including a base connection connecting said respective bases, each of said additional transistors numbered greater than one having an emitter resistor connected between the respective emitter of said additional transistors numbered greater than one and said base connection; and a further resistor connected between said base connection and said other connection terminal.

3. The integrable shunt regulator according to claim 1, wherein the shunt regulator is constructed in CMOS technology, and said first and second transistors are bipolar transistors formed by parasitic structures.

4. The integrable shunt regulator according to claim 2, wherein the shunt regulator is constructed in CMOS technology, and said n additional transistors are bipolar transistors formed by parasitic structures.

5. The integrable shunt regulator according to claim 1, including a chip card in which the shunt regulator is provided.

6. The integrable shunt regulator according to claim 1, including a chip key in which the shunt regulator is provided.

* * * * *